US007134903B1

(12) United States Patent
Pavlovic

(10) Patent No.: US 7,134,903 B1
(45) Date of Patent: Nov. 14, 2006

(54) INSULATION DISPLACEMENT CONNECTION

(75) Inventor: Slobodan Pavlovic, Canton, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 11/248,822

(22) Filed: Oct. 12, 2005

(51) Int. Cl.
*H01R 4/24* (2006.01)

(52) U.S. Cl. ..... 439/404

(58) Field of Classification Search ..... 439/404, 439/417, 418, 403
See application file for complete search history.

(56) References Cited

U.S. PATENT DOCUMENTS

| | | | | |
|---|---|---|---|---|
| 4,252,397 | A | 2/1981 | Eigenbrode et al. | |
| 4,533,199 | A * | 8/1985 | Feldberg | 439/404 |
| 4,581,820 | A * | 4/1986 | Zahn et al. | 29/855 |
| 4,701,001 | A | 10/1987 | Verhoeven | |
| 4,773,752 | A | 9/1988 | Béchet et al. | |
| 5,013,877 | A | 5/1991 | Jervis | |
| 5,314,350 | A * | 5/1994 | Matthews et al. | 439/404 |
| 5,358,424 | A | 10/1994 | Bowen et al. | |
| 5,453,021 | A | 9/1995 | Smith | |
| 5,482,467 | A | 1/1996 | Nolf et al. | |
| 5,551,889 | A * | 9/1996 | Kozel et al. | 439/404 |
| 5,562,478 | A * | 10/1996 | Yamamoto | 439/402 |
| 5,567,173 | A * | 10/1996 | Franckx | 439/418 |
| 5,586,905 | A | 12/1996 | Marshall et al. | |
| 5,624,274 | A * | 4/1997 | Lin | 439/417 |
| 5,664,963 | A * | 9/1997 | Yamamoto et al. | 439/409 |
| 5,782,652 | A * | 7/1998 | Feher et al. | 439/417 |
| 5,971,792 | A | 10/1999 | Lin | |
| 6,062,895 | A | 5/2000 | Lin et al. | |
| 6,074,238 | A | 6/2000 | DeRoss et al. | |
| 6,296,514 | B1 | 10/2001 | Medina et al. | |
| 6,299,362 | B1 | 10/2001 | Gilliland et al. | |
| 6,354,872 | B1 | 3/2002 | Lilienthal, II et al. | |
| 6,370,769 | B1 | 4/2002 | Lilienthal, II | |
| 6,394,833 | B1 | 5/2002 | Bulmer et al. | |
| 6,835,089 | B1 * | 12/2004 | Hayes et al. | 439/404 |
| 6,875,044 | B1 * | 4/2005 | Lee | 439/404 |
| 6,890,210 | B1 | 5/2005 | Lee | |
| 2002/0132517 | A1 | 9/2002 | Tharp et al. | |
| 2004/0185703 | A1 | 9/2004 | Lee | |
| 2004/0244190 | A1 | 12/2004 | Karrasch | |

* cited by examiner

*Primary Examiner*—Tulsidas C. Patel
*Assistant Examiner*—Vladimir Imas
(74) *Attorney, Agent, or Firm*—MacMillan, Sobanski & Todd, LLC

(57) ABSTRACT

A connector for engaging an electrical conductor that includes a wire surrounded by insulation includes a housing formed with a first slot engageable with the wire and including first and second laterally-spaced surfaces having between them a first width that is less than a width of an outer surface of the insulation and greater than a width of the wire. A cover having a second slot engageable with the wire includes third and fourth laterally-spaced surfaces spaced along a length of the conductor from the first and second surfaces, and offset laterally from the first and second surfaces, the third and fourth surfaces having between them a second width that is less than a width of an outer surface of the insulation and greater than a width of the wire.

19 Claims, 3 Drawing Sheets

INSULATION DISPLACEMENT CONNECTION

BACKGROUND OF THE INVENTION

The present invention relates generally to a connector that engages an insulated conductor, secures it against displacement, and produces an electrical connection. More particularly, the invention pertains to a connector such as is used in the electrical system of a motor vehicle.

Insulation displacement connection (IDC) is a technique employing a connector that engages the insulation surrounding an electrical conductor in order to secure the position conductor against unwanted movement and to produce an electric connection. Conductor strain relief restrains the conductor in the IDC and holds the conductor in place to prevent its movement relative to the IDC interface and potential damage to the interface. It also improves conductor pull force performance by cutting into the insulation when the conductor is pulled vertically or longitudinally.

Conventional conductor connectors in the prior art usually include strain relief and position definition features integrated into a mating part. These features often are in the form of bumps on a plastic connector cover, housing or another part of the connector, which bumps are used to form and IDC interface by pushing the conductor into the IDC. Such connectors rely on tolerances between the mating parts and positive mechanical locks to secure the parts mutually. Reliance on dimensional tolerances and mechanical locking permits variability in the position of the conductor relative to the IDC interface and affects the quality of the IDC interface.

The magnitude of the contact force varies in conventional IDCs with the diameter of the conductor and insulation. Furthermore, there is no provision in conventional IDCs for outside pressure on the conductor in two perpendicular directions, which would ensure sufficient contact force to accommodate variations in the size of the conductor. By adjusting the offset of the adjacent slots this contact force can be adjusted. A larger offset is be used for smaller conductor sizes; a smaller offset is used for larger conductor sizes. The magnitude of the contact force between the connector and conductor is preferably adjustable by changing the magnitude of the offset between adjacent slots of the connector.

It is preferred that a connector rely on mechanical engagement with the conductor insulation to provide repeatable positioning of the conductor relative to the connector and to prevent displacement of the conductor relative to the connector, especially displacement resulting from conductor pulling forces, which is an important requirement of the performance of the IDC.

SUMMARY OF THE INVENTION

In a connector according to this invention, adjustment of the contact force between the conductor and connector is achieved by providing two or more adjacent, offset opening through which the conductor passes, the offsets producing engagement of the connector with the insulation on the conductor. Larger offsets are used with smaller conductor sizes; smaller offsets are used with larger conductor sizes. The conductor provides at least eight points of contact with the wire conductor.

A first component of the connector is a housing having the form of a cube having an open top, two slots, located in axially opposite walls, and two latches used to secure the housing to a cover by bending the latches into contact with a surface of the cover. A second connector component is the cover, whose axial direction is slightly longer than that of the housing and contains slots, which are slightly offset from the slots of the housing. The cover has two relief openings, through which the latches pass, and a top surface, against which the latches become engaged when bent into the latching position.

An insulated conductor or wire harness is placed in the slots of the housing component, and the cover is located over the housing such that the conductor passes into the slots of the cover. The cover is then pressed downward until it connects with housing, and the latches are bent over and locked against the cover.

The slots of the cover and housing pierce through the insulation and cause the connector to contact the conductor at up to four points per pair of adjacent slots. Because the slots of the adjacent slots pairs are slightly offset mutually, two adjacent slots push the conductor in opposite directions, thereby producing a moment of force, which produces additional normal force on opposite ends of the adjacent slots. The cover presses both the conductor and insulation down into the slots of the housing producing multiple contact points and enhanced strain relief at the wire insulation.

A connector, according to this invention, for engaging an electrical conductor that includes a wire surrounded by insulation includes a housing formed with a first slot engageable with the wire and including first and second laterally-spaced surfaces having between them a first width that is less than a width of an outer surface of the insulation and greater than a width of the wire. A cover having a second slot engageable with the wire includes third and fourth laterally-spaced surfaces spaced along a length of the conductor from the first and second surfaces, and offset laterally from the first and second surfaces, the third and fourth surfaces having between them a second width that is less than a width of an outer surface of the insulation and greater than a width of the wire.

DESCRIPTION OF THE DRAWINGS

These and other advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
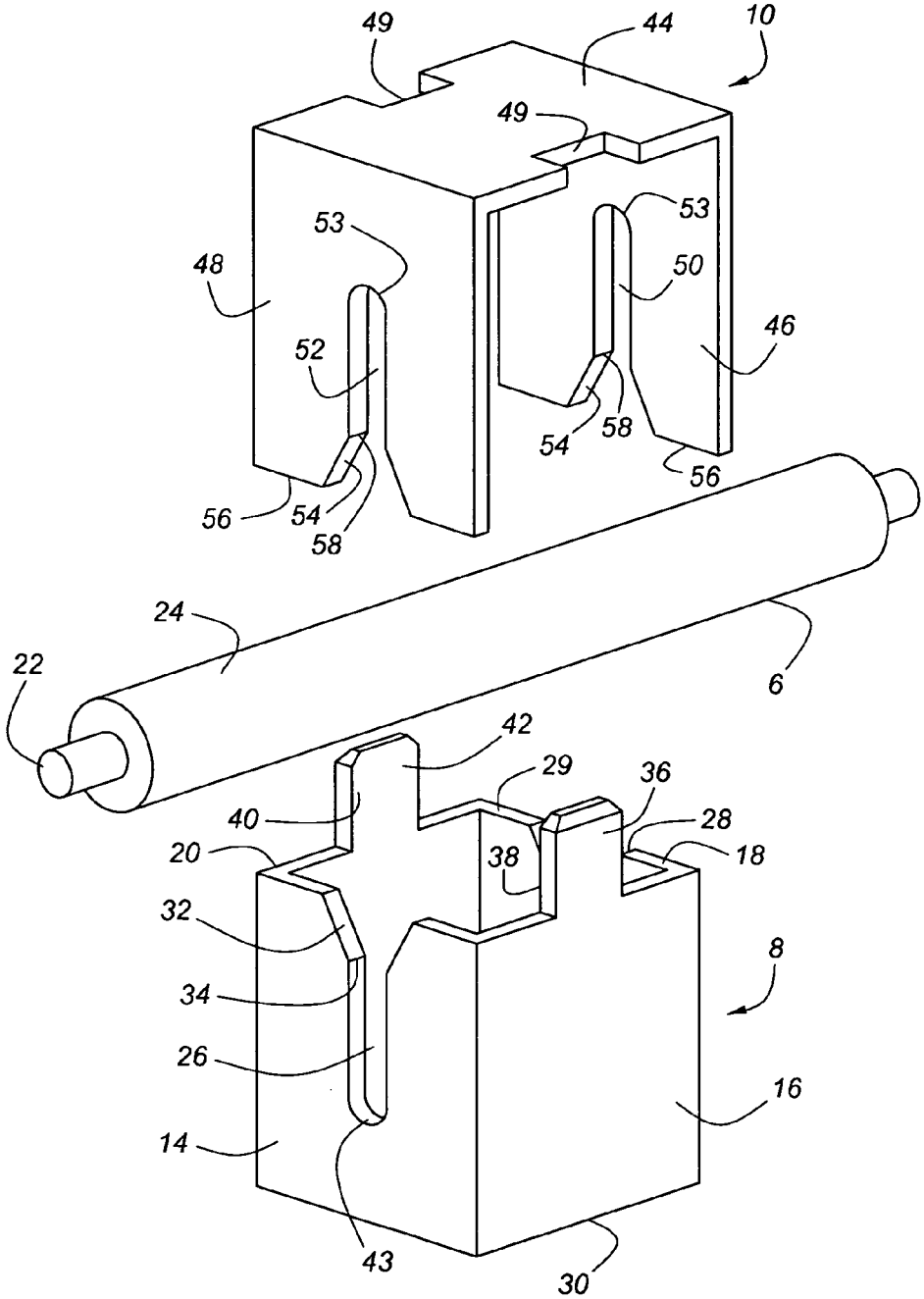
FIG. 1 is a perspective view of a conductor before its insertion into a connector according to this invention.
Figure 3:
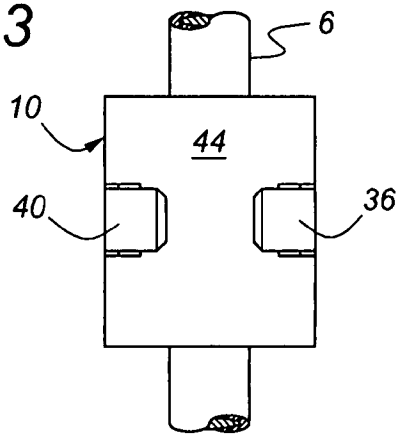
FIG. 3 is a top view of the connector showing the conductor installed in the connector.

Referring now to the figures, an electrical connector for securing a conductor 6 of insulated wire to the connector includes a hollow rectangular housing 8 having an open top, and a cover 10, which closes the top. The housing 8 includes a base and four vertical walls, two axial walls 14, 18 spaced mutually along the length of the conductor, and two lateral walls 16, 20 spaced mutually on opposite sides of the conductor. The conductor 6 may includes a single wire or a bundle of wires 22. In neither case, the conductor 6 is enclosed by a sheath of insulation material 24, which is usually in the form of a circular cylinder, preferably of plastic or another resilient material. The housing 8 and connector 10 are formed of electrically conductive metal, preferably a copper alloy such as 5100 or beryllium copper.

Each of the axial walls 14, 18 is formed with a slot 26, 28 directed generally downward from the upper surface 29 toward the base 30, which is secured to the four walls and closes the bottom of the housing. Preferably the lateral edges of slots 26, 28 are aligned mutually. Each slot 26, 28 extends through the thickness of the respective axial wall and includes an upper tapered transition portion 32, whose width decreases as distance along the slot 26, 28 from the upper surface 29 toward the base 30 increases. At the lower end of the transition 32, each slot 26 includes a throat 34, whose width is less than the outer diameter of the insulation 24 and the radial outer surface of the wire 22. The lateral walls 16, 20, which are secured to the axial walls 14, 18 and to the base 30, are each formed with a latch 36, 40, respectively, each latch having an contact surface 38, 42. Each slot 26, 28 terminates at a semi-circular radius 43.

The cover 10 includes a top 44 and two axial walls 46, 48, each wall being substantially parallel to the axial walls 14, 16 of the housing 8 and spaced mutually along the length of the conductor, such that walls 46, 48 of the cover overlap and are adjacent the axial walls 14, 18 of the housing. The top 44 is relieved locally at each lateral edge 49 to permit a latch 36, 40 to extend through the thickness of the top.

Each of the axial walls 46, 48 is formed with a slot 50, 52 directed generally downward from the top 44 toward the base 30. Preferably the lateral edges of slots 50, 52 are aligned mutually and offset laterally from the corresponding edges of the slots 26, 28 of the housing 8, as seen best in FIGS. 4 and 5. Width of slot 26 being equal to width of slot 52 and width of slot 28 being equal to width of slot 50. Each slot 50, 52 is formed through the thickness of the respective axial wall 46, 48 and includes an lower tapered transition portion 54, whose width decreases as distance along the slot 50, 52 from the lower edge 56 toward the top 44 increases. At the upper end of the transition 54, each slot 50, 52 includes a throat 58, whose width is less than the outer diameter of the insulation 24 and the radial outer surface of the wire 22. Each slot 50, 52 also terminates at a semi-circular radius 53.

FIG. 1 shows the housing 8 disposed to receive the conductor 6 on the transition surface 32 of the slots 26, 28, and the cover 10 located to contact the conductor 6 at the transition surface 54 of the slots 50, 52. Each latch 36, 40 is straight, vertical and aligned with the corresponding relief cutout 49, which provides space for the latch to extend above the top 44.

Installation of the conductor 6 in the connector begins by placing the conductor on the transition surfaces 32 of the slots 26, 28 of the housing 8, engaging the conductor with the transition surfaces 54 of the slots 50, 52 of the cover 10, and then forcing the cover downward such that the conductor passes into the throats 34 of the housing and the throats 58 of the cover. Throats 34 cut into the insulation 24 at opposite lateral sides as the conductor 6 moves downward along slots 26, 28. Throats 58 cut into the insulation at opposite lateral sides as the cover 10 and its slots 50, 52 move downward across the conductor. As the conductor 12 enters and passes through the throats 34, 58, the insulation 22 is compressed and cut locally at each throat by its interference with edges of the throats, and the wire 22 contacts the lateral surfaces of the slots 26, 28, 50, 52, thereby bringing the wire into direct contact with the sides of the slots. After the conductor 6 passes through the throats 34, 58 and the cuts are made through the thickness of the insulation 24, the length of the insulation 24 and wires 22 that is spaced along the conductor from the slots 26, 28, 50, 52 expands radially outward from the compressed condition to the generally circular cylindrical shape seen best in FIGS. 1 and 2.

Figure 5:
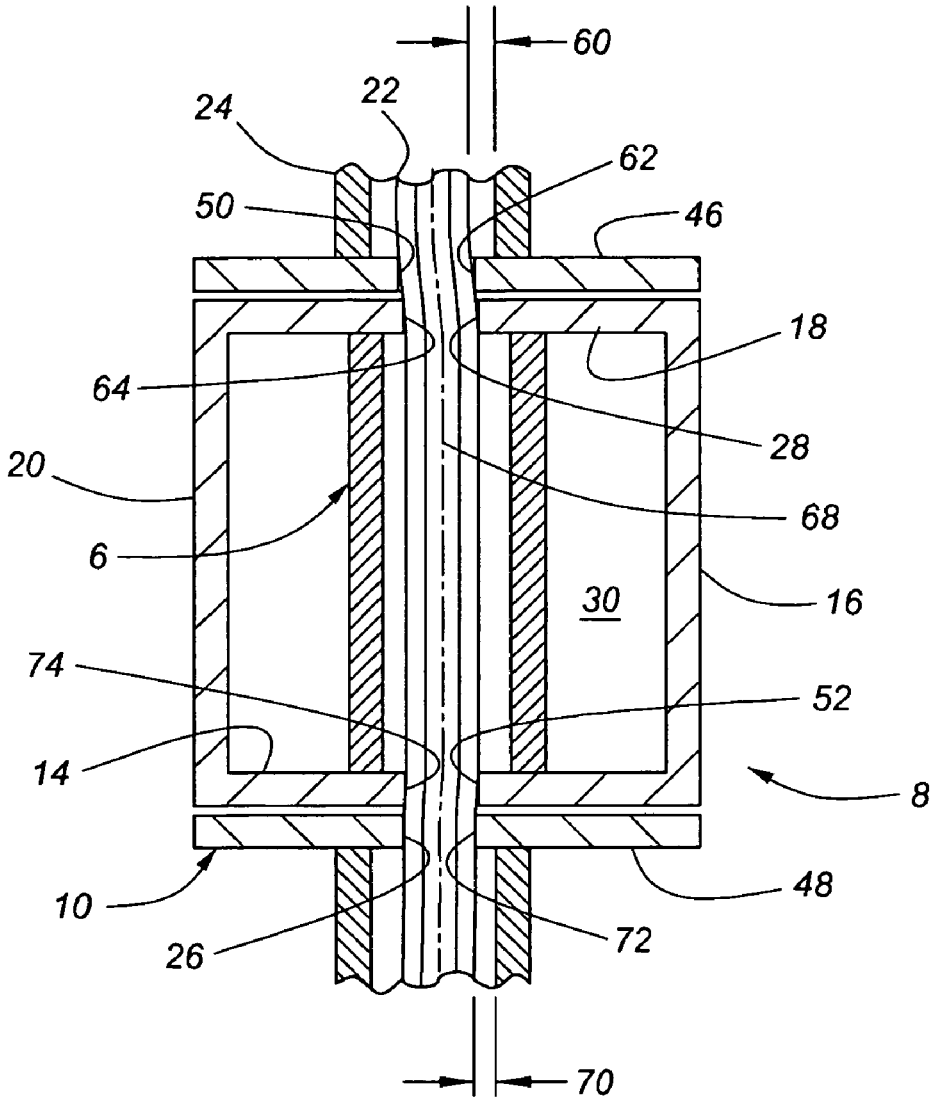
FIG. 5 is a cross section taken at plane 5—5 of FIG. 4.

FIG. 5 shows the lateral offsets between the slots 26, 28 of the housing 8 and the slots 50, 52 of the cover 10. As the conductor 6 moves downward along slots 26, 28, the throats 34 of the housing cut into the insulation 24 at opposite lateral sides. As the conductor 6 moves upward along slots 50, 52, throats 58 cut into the insulation 24 at opposite lateral sides. As the conductor 6 enters and passes through the throats 34, 58, the insulation 24 is compressed and cut by its interference with edges of the throats. But because the lateral offset 60 located at the axial end shown at the top of FIG. 5, surface 62 of slot 50 contacts the wire 22 with a force that is directed leftward, and surface 64 of slot 28 contacts the wire with a force that is directed rightward. The points of contact 62, 64 and the contact forces are spaced axially producing a counterclockwise moment, which tends to rotate the conductor 6 counterclockwise with respect to the axis 68 of the conductor within the housing 8. Similarly, because of the lateral offset 70 located at the axial end shown at the bottom of FIG. 5, surface 72 of slot 52 contacts the wire 22 with a force that is directed leftward, and surface 74 of slot 26 contacts the wire with a force that is directed rightward. The points of contact 72, 74 and the contact forces are spaced axially producing a clockwise moment, which tends to rotate the conductor 6 clockwise with respect to the axis 68 of the conductor within the housing 8. The presence of these moments tends to increase the magnitude of contact between the lateral surfaces of the slots and the wire 22.

Figure 2:
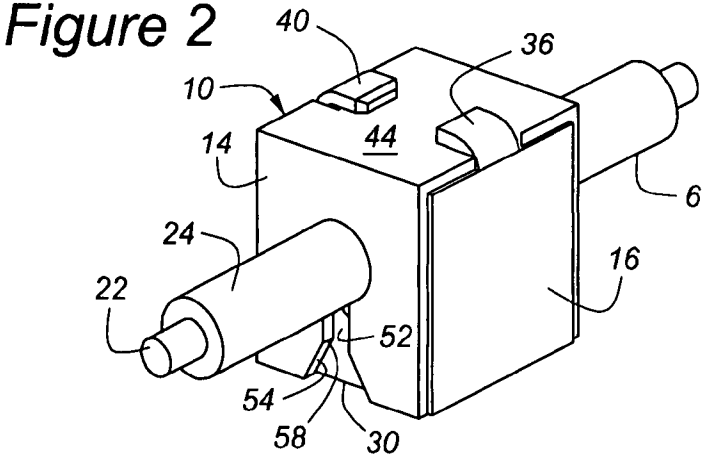
FIG. 2 is a perspective view of the conductor secured to the connector.
Figure 4:
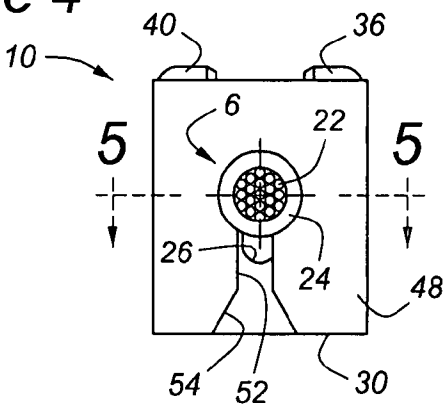
FIG. 4 is an end view of the connector and conductor of FIG. 3.

The correctly installed position of the conductor 6 is reached when the lower edges of the cover 10 are aligned with the base 30 of the housing 8, as shown in FIG. 4. After the housing 8 and cover 10 reach the correctly installed position relative to the conductor 6, the latches 36, 40 are bent laterally inward over the outer surface of the top 44 of the cover such that surfaces 38, 42 contact the cover's top 44. In this position, the tabs 36, 40 secure the cover 10 to the housing 8 and prevent movement of the conductor 6 relative to the connector. FIG. 2 shows the connector with the conductor 6 installed and the tabs 36, 40 bent into the final configuration.

In high temperature applications, such as in the engine compartment of a motor vehicle, the housing is preferably of steel, the connector is of a copper alloy, and the walls 46, 48 of the cover 10 are fitted within the housing rather than overlapping the exterior surface of the housing. The steel housing does not expand as much as the copper alloy cover due to the elevated ambient temperature and restrains thermal expansion of the cover. This configuration maintains a large magnitude of contact force between wire 22 and the cover slots 58, and excellent electrical contact between the housing and the cover.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A connector for engaging a conductor comprising:

a conductor that includes wire and insulation covering the wire;

a housing including a base, a first wall extending from the base and having a first slot engageable with the wire, the first slot including first and second laterally-spaced surfaces having therebetween a first width that is less than width of an outer surface of the insulation and engageable with the wire of the conductor; and a cover having a second slot adjacent the first slot, including third and fourth laterally-spaced surfaces spaced along a length of the conductor from the first and second surfaces, and offset laterally from the first and second surfaces, the third and fourth surfaces having therebetween a second width that is equal to the first width and less than the width of the outer surface of the insulation and engageable with the wire of the conductor.

2. The connector of claim 1 wherein the first slot further includes a first transition portion communicating with the first width, having a width that decreases as distance along a the length of the first slot toward the first width increases.

3. The connector of claim 1 wherein:

the first slot further includes a first transition portion communicating with the first width, having a width that decreases as distance along a length of the first slot toward the first width increases; and the second slot further includes a second transition portion communicating with the second width, having a width that decreases as distance along a length of the second slot toward the second width increases.

4. The connector of claim 1 wherein:

the first and second surfaces are directed toward the base and mutually aligned in a first plane; and the third and fourth surfaces are directed toward the base and mutually aligned in a second plane.

5. The connector of claim 1, wherein:

the housing further comprises a second wall extending from the base, having a third slot spaced along a length of the conductor from the first and second slots, including fifth and sixth laterally spaced surfaces having therebetween a third width that is less than the width of the outer surface of the insulation and engageable with the wire of the conductor; and the cover further comprises a second partition, having a fourth slot including seventh and eighth laterally spaced surfaces, located adjacent the fifth and sixth surfaces, and offset laterally from the fifth and sixth surfaces, the seventh and eighth surfaces having therebetween a fourth width that is equal to the third width and less than the width of the outer surface of the insulation and engageable with the wire of the conductor.

6. The connector of claim 5 wherein:

the first slot further includes a first transition portion communicating with the first width, having a width that decreases as distance along a length of the first slot toward the first width increases;

the second slot further includes a second transition portion communicating with the second width, having a width that decreases as distance along a length of the second slot toward the second width increases;

the third slot further includes a third first transition portion communicating with the third width, having a width that decreases as distance along a length of the third slot toward the third width increases; and the fourth slot further includes a fourth transition portion communicating with the fourth width, having a width that decreases as distance along a length of the fourth slot toward the fourth width increases.

7. The connector of claim 5 wherein:

the first and second surfaces are directed toward the base and mutually aligned in a first lateral plane;

the third and fourth surfaces are directed toward the base and mutually aligned in a second lateral plane;

the fifth and sixth surfaces are directed toward the base and mutually aligned in a third lateral plane; and the seventh and eight surfaces are directed toward the base and mutually aligned in a fourth lateral plane.

8. The connector of claim 5 wherein the housing further comprises:

a third wall extending from the base and second to the first wall and the second wall, including a firth latch for securing the cover to the housing; and a fourth wall extending from the base, secured to the first wall and second wall, and spaced laterally from the third wall, including a second latch for securing the cover to the housing.

9. A connector for engaging an electrical conductor that includes wire and insulation the wire, comprising:

a housing formed with a first slot engageable with the wire and including first and second laterally-spaced surfaces having therebetween a first width that is less than a width of an outer surface of the insulation and engageable with the wire of the conductor; and a cover having a second slot engageable with the wire and including third and fourth laterally-spaced surfaces spaced along a length of the conductor from the first and second surfaces, and offset laterally from the first and second surfaces, the third and fourth surfaces having therebetween a second width that is equal to the first width and less than the width of the outer surface of the insulation and engageable with the wire of the conductor.

10. The connector of claim 9 wherein:

the first slot further includes a first transition portion communicating with the first width, having a width that decreases as distance along a length of the first slot toward the first width increases; and the second slot further includes a second transition portion communicating with the second width, having a width that decreases as distance along a length of the second slot toward the second width increases.

11. The connector of claim 9 wherein:

the housing includes a base;

the first and second surfaces are directed toward the base and mutually aligned in a first plane; and the third and fourth surface are directed toward the base and mutually aligned in a second plane.

12. The connector of claim 9, wherein:

the housing further comprises a third slot engage with the wire, including fifth and sixth laterally spaced surfaces, spaced along a length of the conductor from the first and second surfaces and having therebetween a third width that is less than the width of the outer surface of the insulation and engageable with the wire of the conductor; and the cover further comprises a fourth slot engageable with the wire, including seventh and eighth laterally spaced surfaces, spaced along a length of the conductor from the fifth and sixth surfaces, and offset lateral from the fifth and sixth surfaces, the seventh and eighth surfaces having therebetween a fourth width that is equal to the third width and less than the width of the outer surface of the insulation and engageable with the wire of the conductor.

13. The connector of claim 12 wherein:

the first slot further includes a first transition portion communicating with the first width, having a width that decreases as distance along a length of the first slot toward the first width increases; and the second slot further includes a second transition portion communicating with the second width, having a width that decreases as distance along a length of the second slot toward the second width increases, the third slot further includes a third first transition portion communicating with the third width, having a width that decreases as distance along a length of the third slot toward the third width increases; and the fourth slot further includes a fourth transition portion communicating with the fourth width, having a width that decreases as distance along a length of the fourth slot toward the fourth width increases.

14. The connector of claim 12 wherein:

the housing includes a base;

the first and second surfaces are directed toward the base and mutually aligned in a first lateral plane;

the third and fourth surfaces are directed toward the base and mutually aligned in a second lateral plane;

the fifth and sixth surfaces are directed toward the base and mutually aligned in a third lateral plane; and the seventh and eighth surfaces are directed toward the base and mutually aligned in a fourth lateral plane.

15. The connector of claim 9 wherein the housing further comprises:

a first latch located at a first lateral side for securing the cover to the housing; and a second latch located at a second lateral side opposite the first lateral side for securing the cover to the housing.

16. A connector for engaging an electrical conductor comprising:

a conductor that includes wire surrounded by insulation;

first and second slots formed in a first wall of the conductor, the first and second slots being mutually adjacent, substantially mutually parallel, mutually spaced axially along a length of a conductor that is secured to the connector, and mutually offset laterally, each slot having a first surface and a second surface spaced from and facing the first surface, the first surface contacting the wire and extending through a thickness of the insulation at a first side of the wire, the second surface contacting the wire and extending through a thickness of the insulation at a side of the wire opposite the first side, the first slot having a first width, the second slot having a second width that is equal to the first width.

17. The connector of claim 16, further comprising:

third and fourth slots formed in a second wall of the connector and spaced along the conductor from the first and second slots, mutually adjacent, substantially mutually parallel, mutually spaced axially along a length of the conductor that is secured to the connector, and mutually offset laterally, each third and fourth slot having a third surface and a fourth surface spaced from and facing the third surface, the third surface contacting the wire and extending through a thickness of the insulation at a first side of the wire, the fourth surface contacting the wire and extending through a thickness of the insulation at a side of the wire opposite the first side, the third slot having a third width, the fourth slot having a fourth width that is equal to the third width.

18. The connector of claim 16, wherein the first surface of the first slot and the second surface of the second slot contact the wire.

19. The connector of claim 16, wherein the first surface of the first slot and the second surface of the second slot contact the wire.

the first surface of the first slot and the second surface of the second slot contact the wire; and the third surface of the third slot and the fourth surface of the fourth slot contact the wire.

* * * * *